US005915958A

United States Patent [19]

Kurie

[11] Patent Number: 5,915,958

[45] Date of Patent: Jun. 29, 1999

[54] CONVERTIBLE APPARATUS FOR HEAT TREATING MATERIALS

[75] Inventor: Eugene J. Kurie, Bridgewater, N.J.

[73] Assignee: Ross Air Systems, Inc., Somerville, N.J.

[21] Appl. No.: 09/099,059

[22] Filed: Jun. 18, 1998

[51] Int. Cl.[6] ..... F27B 9/28

[52] U.S. Cl. ..... 432/89; 432/8; 432/59; 219/388

[58] Field of Search ..... 432/8, 59, 89; 219/388, 472

[56] References Cited

U.S. PATENT DOCUMENTS

| | | | |
|---|---|---|---|
| 3,221,416 | 12/1965 | Smith, Jr. | 432/8 |
| 4,217,090 | 8/1980 | Whike et al. | 432/59 |
| 4,878,838 | 11/1989 | Verheyden, Jr. | 432/8 |
| 5,009,016 | 4/1991 | LePisto et al. | 432/8 |
| 5,199,868 | 4/1993 | Autenrieth et al. | 432/8 |
| 5,290,490 | 3/1994 | Nied et al. | 219/773 |

FOREIGN PATENT DOCUMENTS

| | | | |
|---|---|---|---|
| 6-129774 | 5/1994 | Japan | 432/89 |

*Primary Examiner*—Teresa Walberg
*Assistant Examiner*—Gregory A. Wilson
*Attorney, Agent, or Firm*—Cohen, Pontani, Lieberman & Pavane

[57] ABSTRACT

A heating system for heat treating a continuous sheet-like material includes an input end and an output end and a path defined therebetween that extends between the input and output ends for the material to be treated. At least one section of the heating system includes an upper movable heater and a lower stationary heater disposed on confrontingly opposite sides of the material path. A heater lifter is connected to the movable upper heater for operatively displacing the upper heater between a first position for imparting a curing type of heat treatment and a second position for imparting an annealing type of heat treatment to the continuous sheet material as it is advanced through the heating system.

18 Claims, 7 Drawing Sheets

20
100
10
11
12
13
50
40
21b
70
81
22b
71
82
72
23b
40
30
31
32
33
23a
22a
21a
25
65
63
80

CONVERTIBLE APPARATUS FOR HEAT TREATING MATERIALS

BACKGROUND OF THE INVENTION

1. Field of the Invention

The present invention relates to apparatus for heat treatment of a continuous sheet material and that is convertible in configuration for effecting different types of heat treatment.

2. Description of the Prior Art

Furnaces and ovens are used in manufacturing industries for applying various types of heat treatment to obtain desired properties and behaviors of different materials, such as metals, metal alloys, ceramic materials, glass, cellulose, synthetic resins, and other materials of manufacture. The processing of different sizes and types of materials requires that the time and/or the temperature of the heat applied to the material be selectively adjusted to effect a specific heat treatment with a given result. A particular process may also require separate stages of heat treatment of a material at different temperatures and distinct time periods.

In general, heat treatment by furnaces includes preheating, annealing, normalizing, and tempering a metal strip or sheet, and heat treatment by ovens includes drying and curing of an applied coating onto a material. The processing industry utilizes these separate and disparate heat treatment process lines for carrying out the different types of heat treatments because they are performed at significantly different temperatures and using significantly different material processing configurations. For example, the temperature required for curing a coating, such as paint, onto a material and the manner of handling the material during processing differ greatly from the temperature and handling required for annealing a metal strip. The apparatus conventionally used for the curing type of heat treatment is referred to as a curing oven 120 (FIG. 6). The curing oven 120 comprises a coater 129 for applying a coating to a continuous material and confrontingly opposed heaters 121*a* and 121*b* for curing the coating onto the continuous material. The curing oven 120 typically operates with air supply temperatures below 1000° F. so that the material reaches a temperature of 450° F. to 550° F. The apparatus used for the annealing type of heat treatment, on the other hand, is referred to as an annealing furnace 120' as for example shown in FIG. 7. The annealing furnace 120' comprises opposed heaters 121*a*' and 121*b*' positioned in close proximity to the path of the continuous material through the annealing furnace 120'. The furnace 120' typically operates with air supply temperatures above 1000° F. and the material must reach temperatures in the range of 800° F. to 1100° F. for annealing. In addition to these markedly different operating temperatures, another difference between the curing and the annealing processes is that in the curing oven, the continuous material is suspended between the input and output and assumes a free hanging catenary path spanning the full length of the oven; this ensures heating of all surfaces and surface portions and prevents damage to the coating as it is being dried and cured. Since the position of the free hanging strip is not stabilized, and the strip tends to sag and transversely list along its unsupported length, the heaters must be located an appropriate distance from the strip to avoid inadvertent contact and, as a result, only a small or fractional portion of the available energy emitted from each heater is actually applied to the strip. In contrast, the material that passes through the annealing furnace is supported along the entire substantially horizontal path with the heaters thus able to be arranged in close proximity to the material so as to maximize the available heat energy that is applied to the strip.

Because the process line configuration required for drying and curing type heat treatments is markedly different from the configuration required for annealing type heat treatments, the heat treatment industries use separate and different heat treating equipment and a separate process line for each type of heat treatment. As a consequence, preheating, annealing, normalizing, and tempering are typically performed by the manufacturer of the raw continuous material and the drying and curing of coatings are typically performed by a separate coating facility.

Prior art devices employed for regulating the operating temperature of the furnaces and ovens used for heat treatment include rate-controlled devices that vary the rate at which the material being treated passes through the furnace and/or oven; the feeding and advancing of the continuous metal strip is slowed considerably if a high temperature is required, thereby increasing the processing time. Other prior art devices include plural heaters located along the processing line and that are individually put into and taken out of service as a function of the required temperature of heat treatment. Although the temperature ranges of treatment are thereby somewhat adjustable, none of the prior art devices are convertible from in annealing type processing configuration to a curing type processing configuration.

SUMMARY OF THE INVENTION

It is accordingly an object of the present invention to provide a single heat treatment apparatus or facility that is operatively convertible from a first processing configuration for imparting a curing type heat treatment to a continuous material to a second processing configuration for imparting an annealing type heat treatment to the continuous material by, inter alia, altering the spacing of selectively movable heaters from the advancement path of the material through the heat treatment apparatus, thereby utilizing a single process line for both types of heat treatment processes.

In a preferred embodiment of the invention, the heating system or apparatus of a heat treatment process line for heat treating a continuous material includes a selectively movable heater in at least a first section of the heating system. A heater lifter mechanism selectively moves the movable heater along 2 directions substantially transverse to the direction of advance of the continuous material between an annealing heat treatment position and a curing heat treatment position. In the annealing position, the heater is located relatively close to the continuous material for imparting the greatest amount of heat to the continuous material, whereas in the curing position the heater is located more remotely spaced from the continuous material to avoid damage to the continuous material and thereby imparting a reduced amount of heat. In addition, in the annealing position, the continuous material is supported by floatation type nozzles such that air forced toward the continuous material by the floatation type nozzles supports the continuous material so it advances through the heating system. In the curing position, on the other hand, the continuous material is not supported by the floatation nozzles and is thus permitted to form a catenary sag between the input and output ends of at least the initial section of the heating system which includes the movable heater.

The movable heater may be disposed at any position or location about the advancement path of the continuous material, but is preferably above the path and in opposition to a stationary heater disposed in confrontingly opposed condition on the opposite side of, preferably below, the continuous material.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote like elements throughout the several views.

DETAILED DESCRIPTION OF THE PREFERRED EMBODIMENTS

Figure 1:
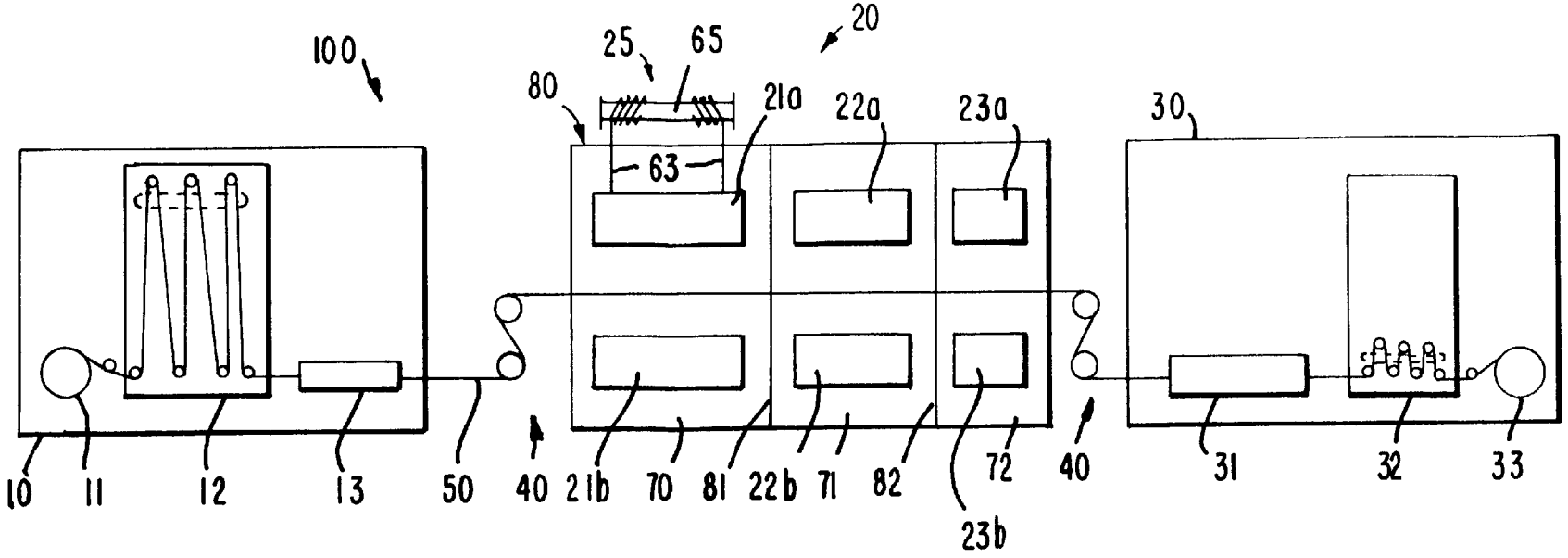
FIG. 1 is a diagrammatic view of a process line including a heating system in accordance with an embodiment of the present invention.

Referring initially to FIG. 1, a process line 100 in accordance with the present invention for heat treating a continuous material 50 includes an entry section 10, a heating system 20, and an exit section 30. The continuous material 50 may comprise, by way of non-limiting example, a continuous sheet, strip, or band of metal, a metal alloy, ceramic, resin, cellulose, glass, or any material capable of being formed into a continuous strip or band. The continuous material 50 is substantially horizontally fed into and advanced longitudinally through the process line 100 for the desired treatment of the strip.

The entry section 10 typically includes an entry coil 11 of or holding the continuous material 50 to be heat treated, an entry accumulator 12 that accommodates an elongated section or length of the continuous material 50, and a washer/chemical treatment device 13. When the entry coil 11 runs out of continuous material 50, the length of continuous material 50 in the accumulator 12 continues to supply material to the heating system 20, thereby allowing a new entry coil to be mounted or connected without interrupting the flow of continuous material 50 through heating system 20. With the new entry coil in place, the input of continuous material 50 to accumulator 12 is resumed and the accumulator arms gradually accumulate an extended length of continuous material 50 as shown in FIG. 1. The washer/chemical treatment device 13 ensures that the continuous material 50 is properly prepared for the subsequent heat treatment in heating system 20.

The heating system 20, which will be described in further detail hereinbelow, comprises a housing 80 formed by a plurality of interconnected heat box panels and enclosing first, second, and third heating sections 70, 71, and 72. The sections 70, 71, 72 are separated by first and second barriers 81 and 82. Each of the heating sections 70, 71, 72 comprises confrontingly opposed upper and lower heaters 21*a* and 21*b*, 22*a* and 22*b*, and 23*a* and 23*b* that are operable for heating the continuous material 50 as it longitudinally advances through heating system 20 to the exit section 30. A heater lift mechanism 25 is operable for moving or displacing the upper heater 21*a* respectively toward and away from the path of the continuous material 50 to thereby selectively adjust the processing configuration and the heat treatment characteristics imparted to the continuous material 50 as it is advanced through heating system 20. The heater lift mechanism 25 includes a cable drum 65 rotatably mounted in housing 80 above the upper heaters 21*a*. Cables 63 connected between the cable drum 65 and upper heater 21*a* support the vertical position of the upper heater. Although a cable drum 65 and cables 63 are shown, heater lifter mechanism 25 may comprise any vertically adjustable mechanical support capable of supporting and moving the upper heater 21*a*. Optional position rollers 40 positioned upstream and downstream of heating system 20 assist in directing or redirecting the continuous material 50 as it travels from one part or section of process line 100 to another.

Although the heating system 20 as herein described includes three successive processing sections 70, 71, 72, those skilled in the art will recognize that the invention is equally applicable to heating systems and arrangements incorporating more or fewer such processing sections. Indeed, arrangements in which the heating system 20 has only a single processing section 70 of movable heaters are within the scope and contemplation of the invention. Thus, the use of three sections in the particular embodiment herein disclosed is intended to be by way of illustrative example and should be understood to be preferred but not required in the practice of the invention.

The exit section 30 includes a cooling device 31, an exit accumulator 32, similar to the entry accumulator 12, and an exit coil 33 on which the heat treated continuous material 50 is wound. Depending upon the type of heat treatment imparted to the continuous material, cooling device 31 may not be required for a particular application or implementation. When the exit coil 33 is full, the exit accumulator 32 allows the full exit coil to be removed and a new exit coil to be positioned in its place without interrupting the flow of continuous material 50 through heating system 20. Exit accumulator 32 thus operatively accumulates the continuous material 50 received from heating system 20 without outputting therefrom any of the received material while the full exit coil is exchanged for an empty one. The new coil can then gradually accommodate the slack length of continuous material 50 that accumulated in the exit accumulator 32 during the coil change.

Figure 2:
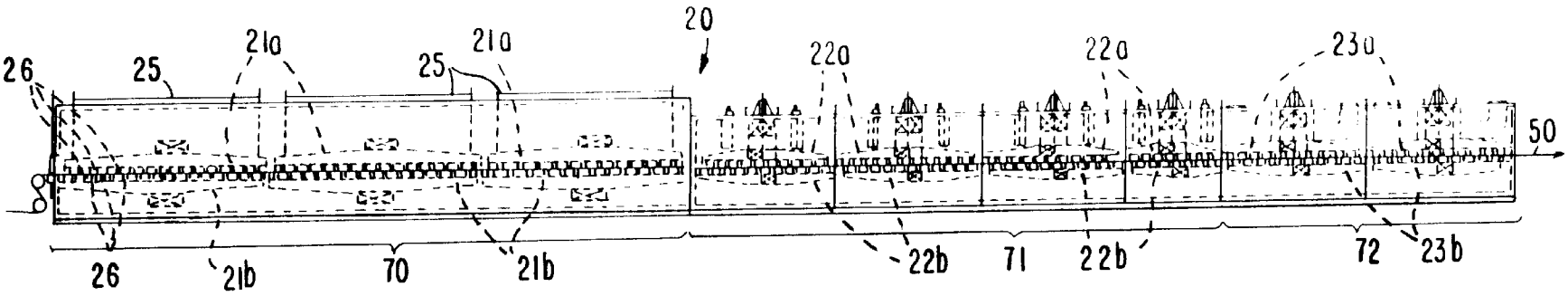
FIG. 2 is a diagrammatic view of the heating system of the process line of FIG. 1.

With reference now to FIG. 2, the first heating section 70 of the heating system 20 of the present invention includes three upper heaters 21*a* and three lower heaters 21*b*. Of course, the illustration and disclosure of three of each of the upper and lower heaters 21*a* and 21*b* is by way of example only and one or more of each could instead be used as a function for example, of the temperature requirements of the heat treatment, the heating capacity of the heaters and other design and processing considerations. In any event, each of the upper heaters 21*a* and lower heaters 21*b* may and will typically be implemented as a manifold which receives heated air from a heat source via a duct and directs the heated air toward the continuous material through a plurality of nozzles 26. The number of nozzles 26 on each heater may also be varied in accordance with the requirements of the particular heat treatment to be imparted to the material. The nozzles 26 provide the dual function of supporting the continuous material 50 while providing heat to the continuous material 50 by directing a stream of heated air toward the opposed surfaces of the continuous material 50. The heat source (not shown) for providing heat to the heaters 21*a* and 21*b* may be located either within or externally of the housing 80 and may by way of an example comprise an electric source or a gas burner or the like.

From coater 29, the continuous material 50 enters the heating section 20 at a position elevated relative to the uppermost roller of entry rollers 40 from which the material 50 enters the heating section in the annealing condition of the apparatus. Those skilled in the art are cognizant that in conventional curing-type processing of continuous materials, the material advances through the oven in generally unsupported condition between the entry and exit locations of the oven and thus assumes a catenary path between the entry and exit supports. Accordingly, in this second or curing condition of the inventive heat processing apparatus, the continuous strip is likewise unsupported—i.e. the continuous material 50 is not supported by heated (or any) air ejected from the lower nozzles 26 or any other structure—in at least the first section 70 of heating system 20 and thus assumes a generally arcuate, catenary path in at least that first portion 70 of heating system 20. Since to effect curing the material 50 enters the first section 70 at an elevated position relative to that at which the material enters section 70 for annealing, and to avoid unintended and potentially damaging contact between the material 50 and upper heaters 21*a*, for curing-type processing the heaters 21*a* are raised to their FIG. 4 second or curing position from their annealing (FIG. 3) position.

The heater lifter 25, which will described in further detail below, is operable for selectively displacing the upper heaters 21*a* relative to the lower heaters 21*b*—which are in the preferred embodiment positively fixed in the housing 8—between an annealing position shown in FIGS. 2 and 3 and a curing position shown in FIG. 4. It should also be noted that each of the heaters 21*a*, 21*b*, 22*a*, 22*b*, 23*a*, and 23*b* may optionally also be movable to an inoperable position by a mechanism other than heater lifter 25 to provide additional access thereto for maintenance and repair purposes, i.e. when the heating system 20 is shut down. The heater lifter mechanism 25, on the other hand, is intended for use during and in conjunction with normal operative use of the heating system 20 for moving the heater 21*a* between its two operating or material processing positions, i.e. the annealing position and the curing position. The movable heaters 21*a* may be connected to the heat source via, for example, a flexible duct to thereby accommodate displacement of the heaters 21*a* during and in connection with their operation. The other, generally final heaters 21*b*, 22*a*, 22*b*, 23*a*, and 23*b* may be connected to the heat source using any suitable flexible or fixed ducting or plenums.

The second heater section 71 is formed of four sets of upper heaters 22*a* and four sets of lower heaters 22*b*. Again, the illustration and disclosure of four sets of each of the upper and lower heaters 22*a*, 22*b* is by way of example only and any desired or appropriate number of heaters may instead be used depending, inter alia, on the temperature requirements of the heat treatment and heating capacity of the heaters. In any event, each of the upper heaters 22*a* and lower heaters 22*b* will also typically be formed by a plurality of supply nozzles 26. This second section 70 comprises only stationary type heaters and there does not include the heater lifting mechanism 25 for moving heaters.

The third heater section 72 of the heating system 20 comprises, by way of illustrative example, two sets of upper heaters 23*a* and two sets of lower heaters 23*b*. This third section 72 is a cooling section which is used for cooling the continuous material 50 to an adequate temperature for post heat processing before the material 50 exits the heating system 20. In some heat treatment types, the heating function of the heaters 23*a*, 23*b* may be unnecessary or undesirable, in which case unheated, ambient air may be directed through the nozzles 26 onto the continuous material for cooling the same. In other applications, a predetermined specific temperature of heated air may be applied to the material for controlling the cooling rate of the continuous material before it exits the heating system 20.

Figure 3:
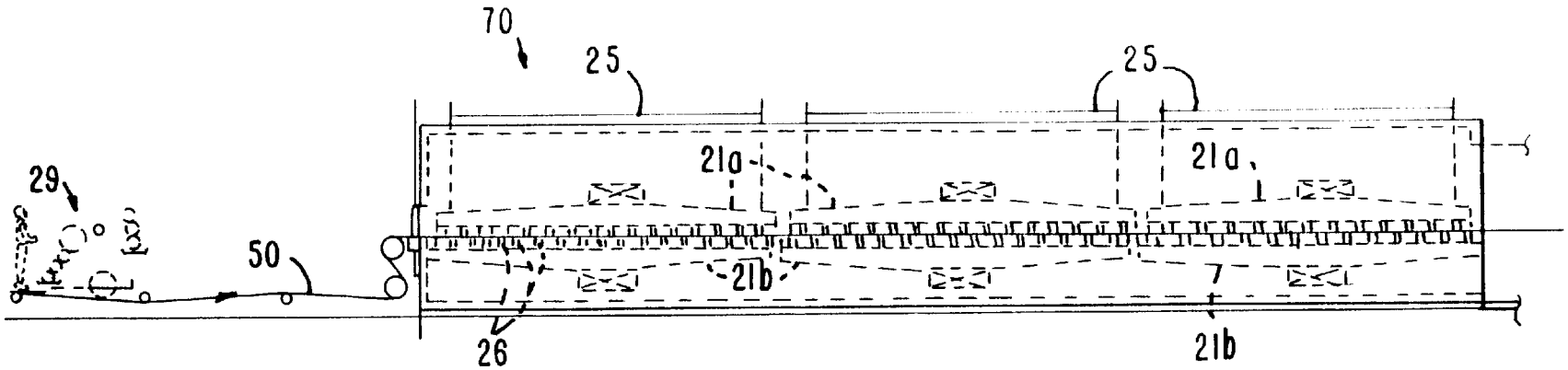
FIG. 3 is a diagrammatic view of a first section of the inventive heater system of the process line shown in FIG. 1 in the material annealing processing condition.

FIG. 3 depicts the first section 70 of heating system 20 in the annealing type processing position or condition in which the movable heaters 21*a* are positioned in their relatively lower most locations in relatively close proximity to the continuous material 50 so as to, inter alia, maximize that portion of the heat radiated from the heating units 26 which is imparted to the material 50 while allowing unimpeded advancing movement of the continuous strip like material 50 through heating system 20. Although this is referred to herein as the annealing position, many other types of heat treatments may also be performed at this first position such, for example, as pre-heating, normalizing, and tempering. As will be apparent in FIG. 3, in the annealing position the continuous material sheet 50 enters the heating system 20 from the uppermost one of the entry rollers 40, and similarly exits (as seen in FIG. 1) heating system 20 about the uppermost one of the exit rollers 40. Preferably, the material 50 is maintained substantially horizontal as it is advanced between the entry and exit rollers 40 and, to that end, is supported by the heated air that is directed by the nozzles 26 of lower heaters 21*b*, 22*b*, 23*b* toward and against the underside or lower face of the sheet-like material 50. Thus, in the annealing position or condition of the inventive apparatus the flow rate of the heated air ejected from the nozzles 26 of the lower heaters is adjusted to provide sufficient upwardly directed forces on the material 50 to maintain the material in a substantially horizontal orientation between the exit and entry rollers 40. In an alternate but less preferred arrangement for annealing, use of the air ejected from the lower heater nozzles to support the material 50 in the substantially horizontal orientation may be limited to the first section 70 of heating system 20 (or to other than less than all of the sections forming system 20), with sheet support being provided in the remaining section(s) by rollers or other known constructions for carrying continuous material as it is advanced along a processing line.

Figure 4:
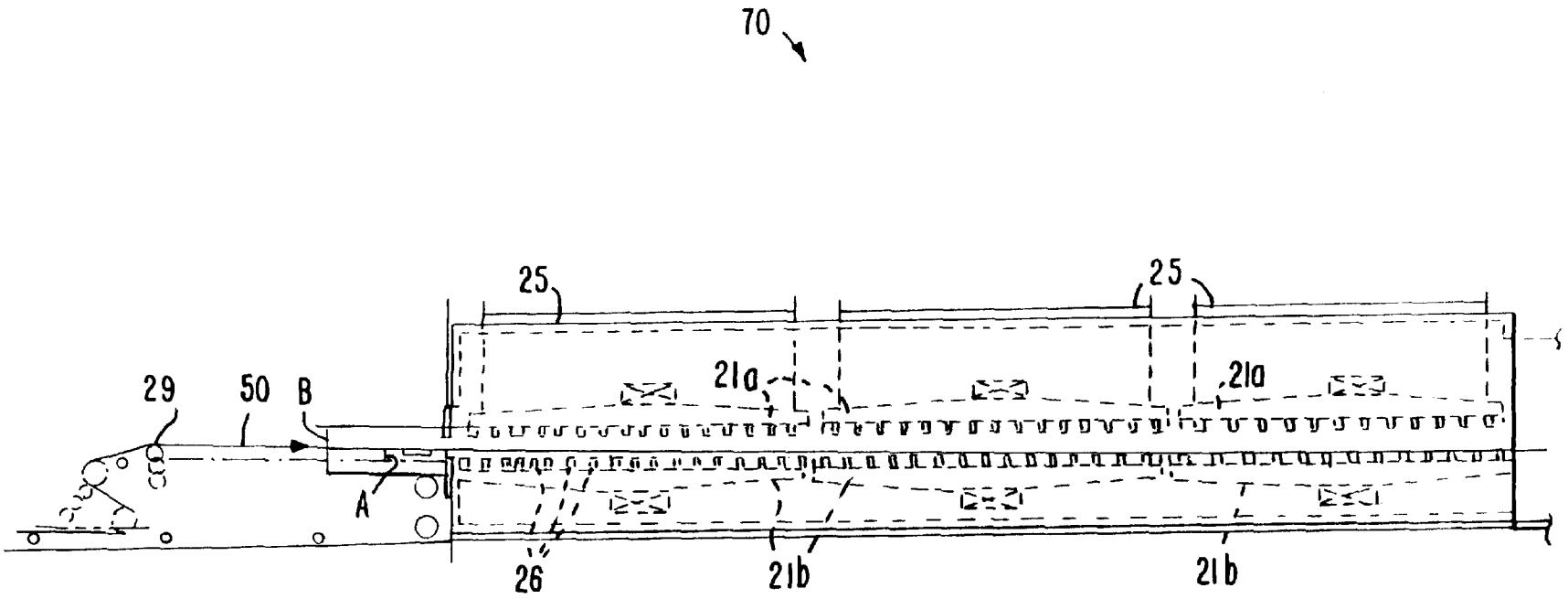
FIG. 4 is a diagrammatic view of the first section of the inventive heater system of the process line shown in FIG. 1 in the material curing processing condition.

As previously pointed out, the heater lifter 25 is operable for selectively displacing the upper heaters 21*a* in the housing 80 and relative to the positionally fixed lower heaters 21*b* and the path of the continuous material 50 between the annealing position of FIG. 3 and the curing position shown in FIG. 4. In the FIG. 4 curing position, the first section 70 is configured for drying coatings that have been applied to the continuous material 50 such, for example, as paints, lacquers, resins, insulation materials, and corrosion resistant coatings. The process line 100 will for this purpose also include a coater 29 (FIG. 4) through which the continuous material is run before it enters the first section 70 when process line 100 is to be used for drying and curing of coatings; the coater 29 applies the coating material to the continuous material 50 and may be bypassed when the heating system 20 is employed for annealing or any other process that does not require coater 29.

From coater 29, the continuous material 50 enters the heating section 20 at a position elevated relative to the uppermost roller of entry rollers 40 from which the material 50 enters the heating section in the annealing condition of the apparatus. Those skilled in the art are cognizant that in conventional curing-type processing of continuous materials, the material advances through the oven in generally unsupported condition between the entry and exit locations of the oven and thus assumes a catenary path between the entry and exit supports. Accordingly, in this second or curing condition of the inventive heat processing apparatus, the continuous strip is likewise unsupported—i.e. the material 50 is not supported by heated (or any) air ejected from the lower nozzles 26 or any other structure—in at least the first section 70 of heating system 20 and thus assumes a generally arcuate, catenary path in at least that first portion 70 of heating system 20. Since to effect curing the material 50 enters the first section 70 at an elevated position relative to that at which the material enters section 70 for annealing, and to avoid unintended and potentially damaging contact between the material 50 and upper heaters 2*a*, for curing-type processing the heaters 21*a* are raised to their FIG. 4 second or curing position from their annealing (FIG. 3) position.

A temperature withstand range of the heater lifter mechanism 25 limits the maximum allowable temperature in the first section 70 of heating system 20 to prevent damage to the heater lifting mechanism 25. As a consequence, the highest annealing temperatures required for certain types of continuous material 50 may not be achievable in the first section 70. In those cases, the second section 71 of heating system 20—both the upper and lower heating sections 22*a*, 22*b* are positionally fixed—is used to impact the desired elevated heat treatment temperatures to the continuous material 50. Since in such instances the temperatures in the second section 71 are greater than those permitted in first section 70, a first barrier 80 may be provided to separate the first section 70 from the second section 71 so that the heater lifter cables 63 are not subjected to detrimental temperatures. Likewise, a second barrier 81 may separate the second section 71 from third section 72 so that appropriate controlled cooling may be attained in the third section unaffected by the higher temperature air in second section 71.

Also within the contemplation of the invention is convertible a heating system having one or more heating sections, wherein each of the heating sections includes a movable upper heater 21*a*. However, heat treatments to be carried out by this modified heating system are limited to those requiring no more then the withstand temperature of the heater lifting mechanisms 25.

Figure 5:
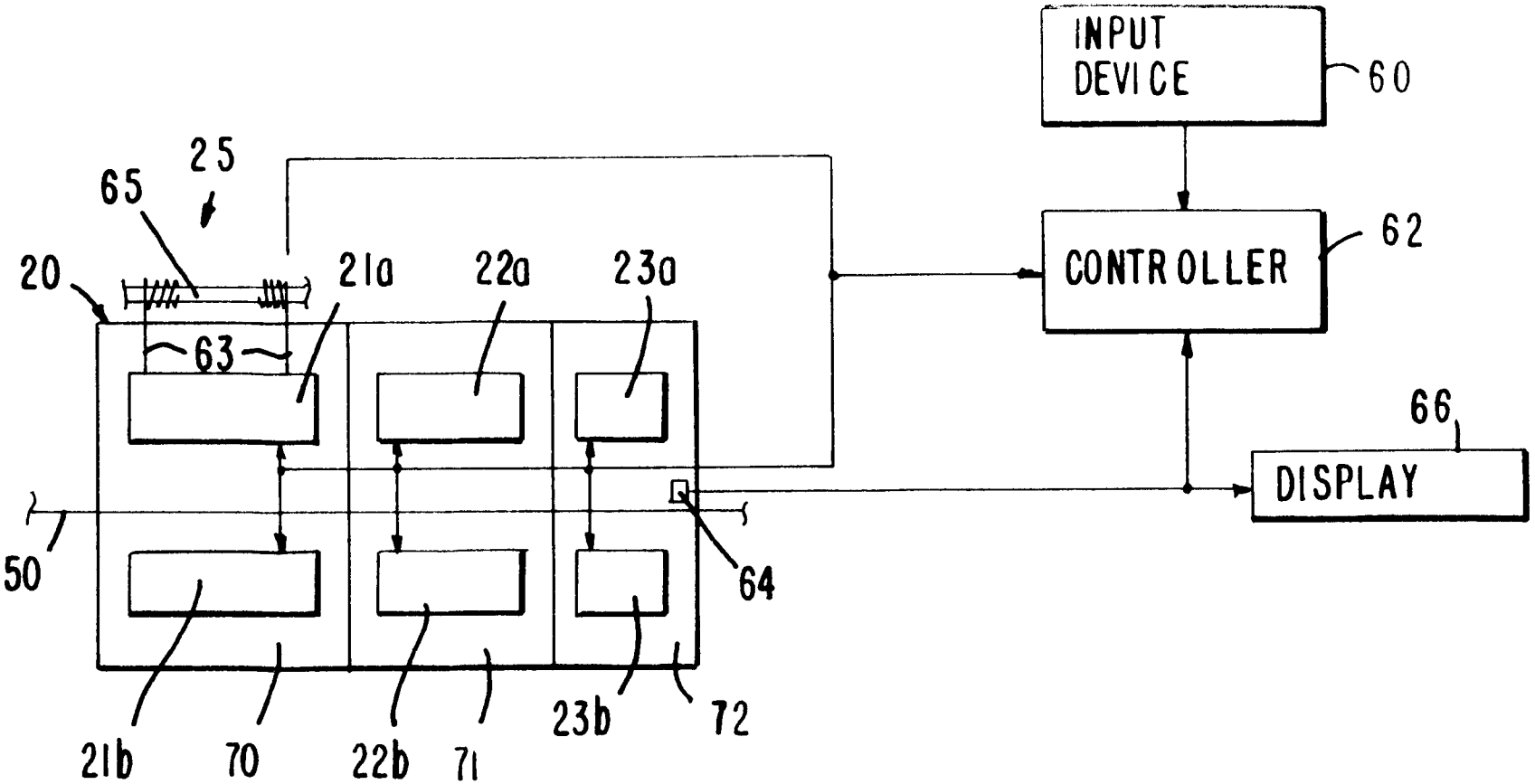
FIG. 5 is a block schematic diagram of a control system for the inventive heater system.
Figure 6:
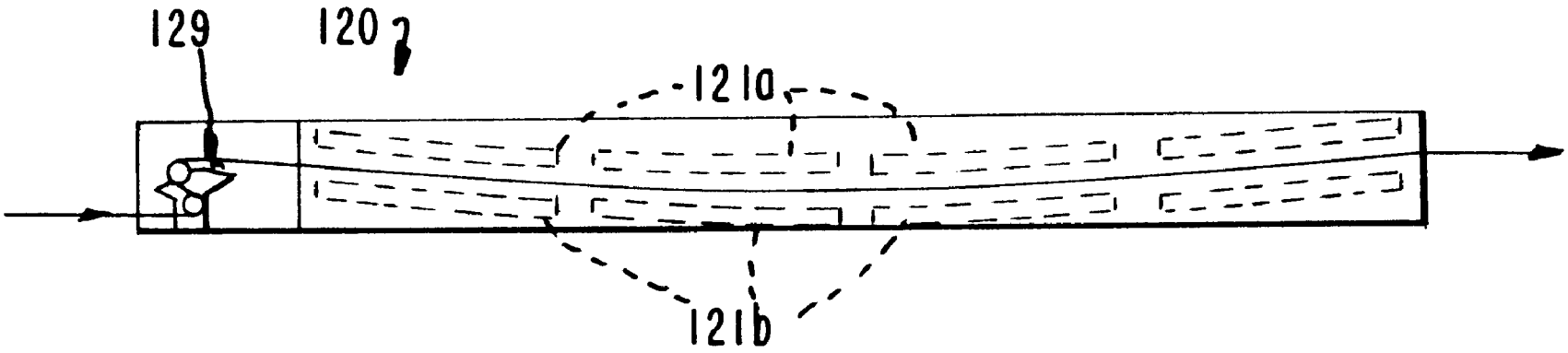
FIG. 6 PRIOR ART
FIG. 6 is a diagrammatic view of a prior art curing oven.
Figure 7:
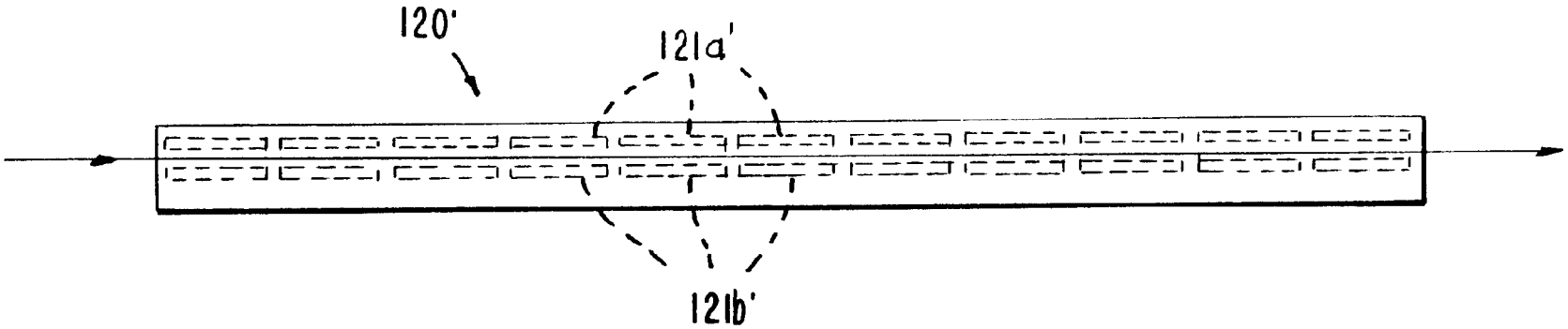
FIG. 7 PRIOR ART
FIG. 7 is a diagrammatic view of a prior art annealing furnace.

FIG. 5 depicts a user controllable input device 60 that may be connected to the heater lifter is 25 via a controller 62 to permit a user to selectively adjust the elevated position of the upper heaters 21*a*. User input device 60 may take the form of a keyboard, dials, buttons, touchscreen, manual hand crank, or other user-operable adjustment devices. A position selection may thereby be implemented by using the user input device 60 through which the user selects one of the annealing and the curing positions. In a further embodiment, the user input device 60 is operable to allow the user to fine tune the position of the upper heater 21*a* from the initially-set curing position. Different types of continuous materials exhibit different amounts of elasticity so that some will assume a more severe catenary sag than others and will exhibit greater deviations from the catenary path resulting, for example, from disturbances in the process line 100. Therefore, fine adjustments to the amount of heater lift or displacement from the curing position allow user positioning of the upper heaters 21*a* at the most efficient locations attainable as a function of the type of continuous material being dried and cured in the curing condition of the apparatus. That is, the user can selectively position the upper heater 21*a* so as to impart the largest possible amount of heat is to the continuous material 50 while avoiding detrimental contact with the material strip. The controller 62 may also include predetermined settings for specific types of materials so that a user may simply input or select the type of continuous material to be heat treated. In this further modification, the user may indicate the type of material 50 to be processed and the controller 62 will automatically position the upper heaters 21*a* at the most efficient curing position based on the material type. In embodiments having more than one movable heater 21*a* in the first section, the controller 62 may individually and independently control each of the movable heaters 21*a*.

The controller 62 may further include a temperature control for adjusting the temperature and the amount or volume of air flow supplied through the floatation nozzles 26 of the heaters 21*a*, 21*b*, 22*a*, 22*b*, 23*a*, and 23*b*. Optionally, each individual section 70, 71, 72 may be separately controlled and each set of heaters within each section may be separately controlled. A temperature detector 64 having an output connected to a display 66 may also be provided at or proximate the output or exit end of each section to be controlled in the heating system 20 for monitoring the exit temperature of the continuous material 50. In FIG. 5, the temperature detector 64 is shown by way of example at the exit end of third section 72. However, temperature detector 64 may be positioned in any of the sections 70, 71, 72 and may be positioned in each of the sections 70, 71, 72 for temperature separate temperature monitoring and control of each. The display 66 may be mounted as a separate unit or as a part of the input device 60 or controller 62. Temperature detector 64 and display 66 permit continuous monitoring of the processed material output temperature by the user so that the temperature imparted in each section may be adjusted as necessary through input device 60 to maintain a desired temperature. By also feeding the output of the temperature detector 64 to controller 62, the controller may be utilized to automatically dynamically adjust the temperature of the air and the flow of air through the floatation nozzles 26 in response to the type of heat treatment and for user selected temperature settings entered at input device 60 to maintain a constant material temperature. In this optional enhancement, the user may initially set a desired temperature for the desired type of heat treatment; the controller will then fine tune the temperatures and/or air flow rates of the heaters 21*a*, 21*b*, 22*a*, 22*b*, 23*a*, 23*b* in response to the output signal of temperature detector(s) 64 and the manually entered temperature settings through input device 60 to impart the desired temperature and processing characteristics to the continuous material.

While there have been shown and described and pointed out fundamental novel features of the present invention as applied to a preferred embodiment thereof, it will be understood that various omissions and substitutions and changes in the methods described and in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. A convertible heating system for use in a process line for heat treating a continuous sheet material as the continuous sheet material is advanced along the heating system, wherein the process line includes an entry section for supplying untreated continuous sheet material to the convertible heating system and an exit section for receiving the treated continuous sheet material from the convertible heating system, said convertible heating system comprising:

a housing having an input end for receiving the continuous sheet material to be heat treated and an output end and defining a path along which the material is operatively advanced through the housing from the input end to the output end, said housing, enclosing a plurality of heating sections disposed serially along the path;

a convertible section of said plural heating sections comprising confrontingly opposed first and second heaters disposed on respectively opposite sides of said path for directing heated air from said heaters toward opposed faces of the continuous sheet material as the continuous sheet material is advanced along the path in said housing, said second heater being positionally fixed in said housing and said first heater being movable substantially transverse to said path between a first position predeterminately spaced from said second heater for applying a first heat treatment to the continuous sheet material and a second position more remote from the second heater than said predeterminate spacing of said first position for applying a second heat treatment to the continuous sheet material; and a heater lifting device connected to said first heater and selectively operable to move said first heater between said first and second positions of the first heater for converting said heating system between first and second heat treatment configurations for applying said first and second heat treatments to the continuous sheet material;

said second heater comprising means for directing a stream of heated air substantially upwardly onto one of the opposed faces of the continuous sheet material so as to support the continuous sheet material on the stream of heated air in a substantially horizontal orientation through said convertible section in said first position of the first heater for applying said first heat treatment to the continuous sheet material, and for directing the stream of heated air substantially upwardly onto the one of the opposed faces of the continuous sheet material without supporting the continuous sheet material on the stream of heated air and thereby permitting the sheet material to assume a catenary sag through said adjustable section in said second position of the first heater for applying said second heat treatment to the unsupported continuous sheet material.

2. The convertible heating system of claim 1, wherein said adjustable section comprises a first one of said serially-disposed plural sections located immediately adjacent said entrance end of the convertible heating system.

3. The convertible heating system of claim 1, wherein said second heater comprises a plurality of floatation nozzles configured for directing the heated air from the second heater upwardly toward the continuous sheet material so as to support the continuous sheet material on the heated air in said substantially horizontal orientation in said first position of the first heater.

4. The convertible heating system of claim 1, wherein said first heat treatment comprises one of annealing, tempering, preheating and normalizing, and said second heat treatment comprises curing.

5. The convertible heating system of claim 1, wherein said input end of the housing is configured for introducing the continuous sheet material into the housing at a first distance above said second heater in said first position of said first heater for applying said first heat treatment to the continuous sheet material as the sheet material is advanced along said path, and at a second distance above said second heater and greater than said first distance for applying said second heat treatment to the continuous sheet material as the sheet material is advanced along said path, said second distance being sufficient to avoid contact of the second heater with the continuous sheet material in said catenary sag.

6. The convertible heating system of claim 1, wherein said first heater comprises a plurality of movable heater units, and wherein said heater lifting device is connected to said plural heater units for operatively displacing each said heater unit to a distinct second position so that each said heater unit is differently spaced from the second heater in said second position of the first heater for applying said first heat treatment to the continuous sheet material in said catenary sag.

7. The convertible heating system of claim 6, wherein said distinct second positions of said heater units are selected so that said heater units are spaced from said second heater so as to substantially track the catenary sag of the continuous sheet material.

8. The convertible heating system of claim 5, wherein said first heater comprises a plurality of movable heater units, and wherein said heater lifting device is connected to said plural heater units for operatively displacing each said heater unit to a distinct second position so that each said heater unit is differently spaced from the second heater in said second position of the first heater for applying said first heat treatment to the continuous sheet material in said catenary sag.

9. The convertible heating system of claim 8, wherein said distinct second positions of said heater units are selected so that said heater units are spaced from said second heater so as to substantially track the catenary sag of the continuous sheet material.

10. The convertible heating system of claim 1, further comprising a controller having an output connected to said heater lifting device and a user-operable input device for user selection of one of the first and second heat treatment configurations, said controller output being responsive to said user-operable input device for causing said heater lifting device to move said first heater between said first and second positions in response to said controller output.

11. The convertible heating system of claim 10, further comprising a temperature detector located in said housing proximate an output end of one of said plural heating sections for operatively detecting a temperature of the continuous sheet material proximate the output end of said one of the plural heating sections, and connected to said controller for use by said controller in causing said heater lifting device to adjust at least one of the first and second positions of the first heater for effecting a predetermined heat treatment of the continuous sheet material in said housing.

12. The convertible heating system of claim 11, wherein said user-operable input device comprises a temperature selection device operable for user selection of a desired temperature of the continuous sheet material at the output end of said one of the plural heating sections, and wherein said controller is operable for automatically adjusting a heat output applied to the continuous sheet material in said one of the plural heating sections in response to the user-selected desired temperature and the temperature detected by said temperature detector.

13. The convertible heating system of claim 1, wherein said housing further comprises a barrier disposed separatingly between adjacent ones of said plural heating sections for enabling maintenance of desired temperature differentials between the adjacent heating sections separated by said barrier.

14. The convertible heating system of claim 1, wherein the process line further includes a coater between said entry section and said convertible heating system for applying a coating to the continuous sheet material before the sheet material enters the heating system for application of the second heat treatment to the continuous sheet material in said housing, and wherein said input end of the housing is configured for introducing the continuous sheet material into the housing at a first distance above said second heater in said first position of said first heater and when the continuous sheet material is diverted from the coater for applying said first heat treatment to the continuous sheet material as the sheet material is advanced along said path, and said input end of the housing is configured for introducing the continuous sheet material into the housing from the coater at a second distance above said second heater and greater than said first distance for applying said second heat treatment to the continuous sheet material as the sheet material is advanced along said path, said second distance being sufficient to avoid contact of the second heater with the continuous sheet material in said catenary sag.

15. The convertible heating system of claim 1, wherein said plural heating sections further comprise a fixed heating section serially following said convertible section and having a set of upper and lower heaters confrontingly opposed on respectively opposite sides of said path for directing heated air from said upper and lower heaters toward the opposed faces of the continuous sheet material as the continuous sheet material is advanced along the path in said fixed heating section, and a cooling section following said fixed heating section for cooling the continuous sheet material as the continuous sheet material is advanced along the path in said cooling section by directing air toward the opposed faces of the continuous sheet material in said cooling section.

16. The convertible heating system of claim 15, wherein predeterminately heated air is directed toward the opposed faces of the continuous sheet material in said cooling section.

17. The convertible heating system of claim 15, wherein unheated ambient air is directed toward the opposed faces of the continuous sheet material in said cooling section.

18. The convertible heating system of claim 15, wherein said housing further comprises a barrier disposed separatingly between adjacent ones of said plural heating sections for enabling maintenance of desired temperature differentials between the adjacent heating sections separated by said barrier.

* * * * *